US006894469B2

(12) United States Patent
Nakajima et al.

(10) Patent No.: US 6,894,469 B2
(45) Date of Patent: May 17, 2005

(54) POWER SUPPLY CIRCUIT

(75) Inventors: Kenichi Nakajima, Hanyu (JP); Ikuo Osawa, Kiryu (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/390,284

(22) Filed: Mar. 17, 2003

(65) Prior Publication Data

US 2004/0012377 A1 Jan. 22, 2004

(30) Foreign Application Priority Data

Mar. 20, 2002 (JP) ..... 2002-078432

(51) Int. Cl.[7] ..... G05F 1/44

(52) U.S. Cl. ..... 323/275; 323/280; 323/281

(58) Field of Search ..... 323/273, 274, 323/275, 280, 281, 313

(56) References Cited

U.S. PATENT DOCUMENTS 5,625,278 A * 4/1997 Thiel et al. ..... 323/280
5,828,204 A * 10/1998 Jansen ..... 323/266

* cited by examiner

*Primary Examiner*—Gary L. Laxton
(74) *Attorney, Agent, or Firm*—Fish & Richardson P.C.

(57) ABSTRACT

The power supply circuit of this invention includes a constant voltage element which generates an output voltage insensitive to change in ambient temperature, a power supply transistor, to a base of which the output voltage of the constant voltage element is applied and from an emitter of which a power supply voltage is provided, a load connected to an emitter of the power supply transistor and a differential amplifier to one input terminal of which an emitter voltage of the power supply transistor is applied and to the other input terminal of which a voltage corresponding to the output voltage of the constant voltage element is applied, and a voltage corresponding to an output voltage of which is applied to the base of the power supply transistor.

9 Claims, 1 Drawing Sheet

POWER SUPPLY CIRCUIT

BACKGROUND OF THE INVENTION

1. Field of the Invention

This invention relates to a power supply circuit providing an integrated circuit with a supply voltage, specifically to a power supply circuit capable of supplying a constant voltage insensitive to change in ambient temperature.

2. Description of the Related Art

Generally speaking, it is not easy to obtain a constant voltage with an integrated circuit, because characteristics of transistors and resistances in the integrated circuit are affected by change in ambient temperature. Hence, an element insensitive to the temperature change such as a zener diode is often used to obtain the constant voltage. A large current, e.g. 100 mA to 200 mA, flows through a power supply transistor, which supplies the current to a power supply line in the integrated circuit. Because it is difficult for the integrated circuit to include the power supply transistor with such a larger current capacity, the power supply transistor is placed outside the integrated circuit.

FIG. 2 shows an example of a power supply circuit according to a conventional art. A power supply voltage of 11V, for example, is provided to a terminal 2 located outside the integrated circuit, from which the power supply voltage is applied to the inside of the integrated circuit 1 through a resistance 3 and a pin 4 of the integrated circuit 1. The voltage at the pin 4 is applied to a zener diode 5, which generates a constant voltage between both ends of it, insensitive to the change in the ambient temperature. The constant voltage across the zener diode 5 is applied to a bleeder resistance 8 consisting of a resistance 6 and a resistance 7. The bleeder resistance 8 divides the constant voltage proportionally to a ratio between the resistance 6 and the resistance 7. The divided voltage is led to outside of the integrated circuit 1 through a buffer circuit 9 and a pin 10 of the integrated circuit 1.

A power supply transistor 11 is made of a discrete transistor disposed outside the integrated circuit 1, and provides a constant voltage from its emitter in accordance with a voltage applied to its base. The emitter voltage of the power supply transistor 11 is fed back to the inside of the integrated circuit 1 through a pin 12 as a power supply voltage of the integrated circuit 1.

The pin 12 makes a so-called power supply pin of the integrated circuit 1, from which the power supply voltage is provided to various circuit blocks 13, 14 and 15 in the integrated circuit 1. Thus the constant voltage can be supplied to the circuit blocks in the integrated circuit, according to the power supply circuit of FIG. 2.

The configuration shown in FIG. 2 can provide the pin 10 with the voltage insensitive to the change in the ambient temperature. However, the power supply transistor 11 has temperature characteristics specific to a discrete device, and a voltage between its base and emitter fluctuates, albeit only slightly. As a result, the power supply voltage provided to the circuit blocks 13, 14 and 15 fluctuates.

It is conceivable to apply a temperature dependent voltage to the pin 10, so that the fluctuation in the applied voltage would cancel the fluctuation due to the temperature characteristics of the power supply transistor 11. However, it is difficult to implement.

As described above, eliminating the fluctuation in the power supply voltage has been difficult.

SUMMARY OF THE INVENTION

This invention is made considering the problems addressed above. The power supply circuit of this invention includes a constant voltage element which generates a constant voltage insensitive to the change in the ambient temperature, a power supply transistor provided the output voltage of the constant voltage element to its base, a load connected to the emitter of the power supply transistor and a differential amplifier applied the emitter voltage of the power supply transistor to one of its input terminals and a voltage corresponding to the output voltage of the constant voltage element to the other of its input terminals and providing its output signal to the base of the power supply transistor. The power supply circuit generates a voltage corresponding to the output voltage of the constant voltage element at the emitter of the power supply transistor.

Or, the power supply circuit of this invention includes a constant voltage element which provides a constant voltage insensitive to the change in the ambient temperature, a power supply transistor provided the output voltage of the constant voltage element to its base and supplying a power supply voltage from its emitter, a load connected to the emitter of the power supply transistor and a differential amplifier applied the emitter voltage of the power supply transistor to one of its input terminals and a voltage corresponding to the output voltage of the constant voltage element to the other of its input terminals and providing its output signal to the base of the power supply transistor, wherein the constant voltage element, the load and the differential amplifier are disposed in an integrated circuit while the power supply transistor is disposed out of the integrated circuit.

Otherwise, the power supply circuit of this invention includes a constant voltage element which provides a constant voltage insensitive to the change in the ambient temperature, a power supply transistor provided the output voltage of the constant voltage element to its base, a load connected to the emitter of the power supply transistor, a differential amplifier applied the emitter voltage of the power supply transistor to one of its input terminals and a voltage corresponding to the output voltage of the constant voltage element to the other of its input terminals and providing its output signal to the base of the power supply transistor and a switch connecting or disconnecting the constant voltage element and the base of the power supply transistor. The power supply circuit generates a power supply voltage at the emitter of the power supply transistor by connecting or disconnecting the switch.

DETAILED DESCRIPTION OF THE INVENTION

Figure 1:
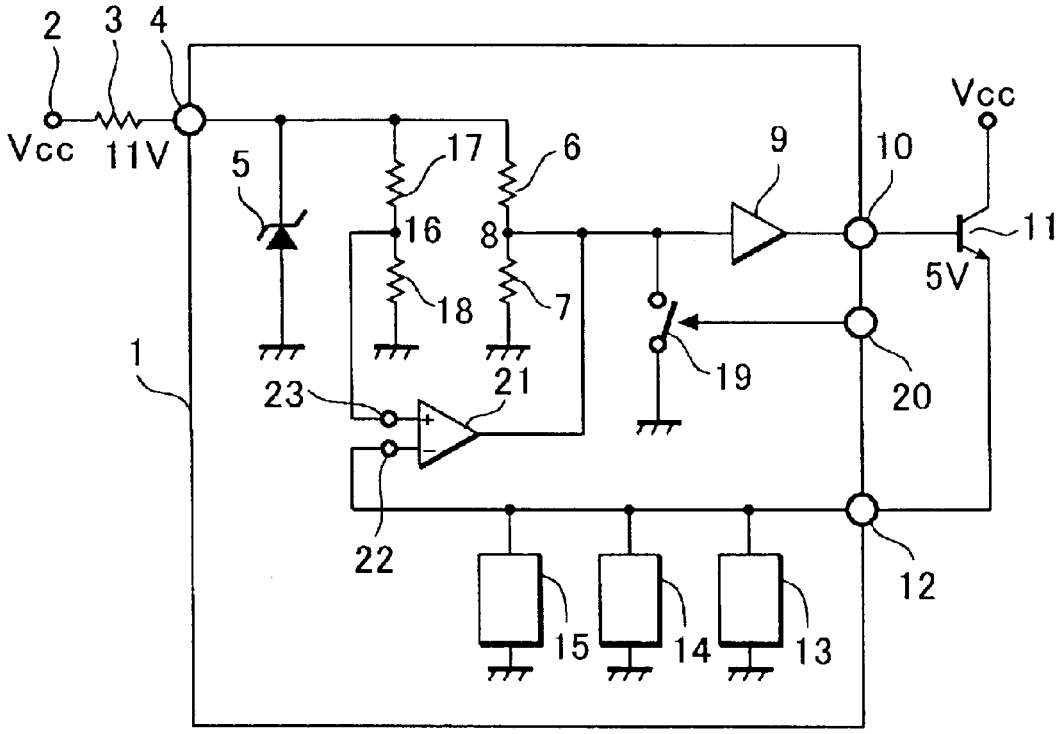
FIG. 1 is a block diagram showing a power supply circuit according to an embodiment of this invention.

A power supply circuit according to an embodiment of this invention will be explained referring to FIG. 1 hereinafter.

A resistance 17 and a resistance 18 make a bleeder resistance 16. A switch 19 is turned on and off by a control signal from a pin 20. A voltage at an emitter of a power supply transistor 11 is applied to an input terminal 22 of a differential amplifier 21., while a voltage from the bleeder resistance 16 is applied to the other input terminal 23 of the differential amplifier 21 which provides a buffer circuit 9 with its output signal. The same symbols are assigned to the same components in FIG. 1 as in FIG. 2, and explanations on them are omitted.

Figure 2:
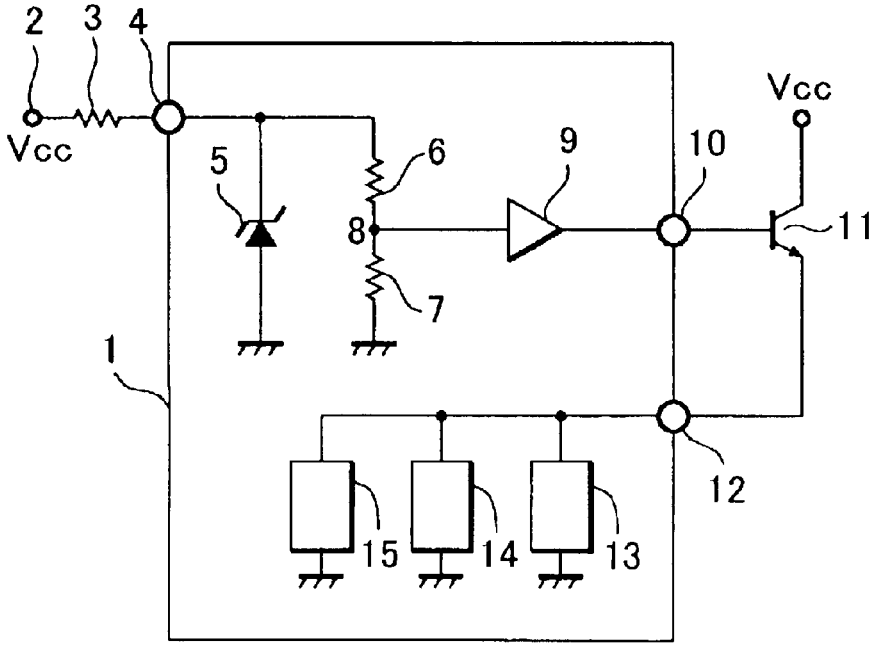
FIG.2 PRIOR ART
FIG. 2 is a block diagram showing a power supply circuit according to a conventional art.

Next, operation of the circuit shown in FIG. 1 is explained. A power supply voltage of 11V for example, is provided to a terminal 2 located outside the integrated circuit, from which the power supply voltage is applied to the inside of the integrated circuit 1 through a resistance 3 and a pin 4 of the integrated circuit 1. The voltage at the pin 4 is applied to a zener diode 5, which generates a constant voltage between both ends of it, insensitive to the change in the ambient temperature. The constant voltage across the zener diode 5 is applied to the bleeder resistance 16 and a bleeder resistance 8 consisting of a resistance 6 and a resistance 7.

A divided voltage by the bleeder resistance 8 is led to the outside of the integrated circuit 1 through a buffer circuit 9 and a pin 10 of the integrated circuit 1. A power supply transistor 11 is made of a discrete transistor disposed outside the integrated circuit 1 and provides a constant voltage, for example 5V, from its emitter, in accordance with a voltage applied to its base. The emitter voltage of the power supply transistor 11 is fed back to the inside of the integrated circuit 1 through a pin 12 as a power supply voltage of the integrated circuit 1. The pin 12 makes a so-called power supply pin of the integrated circuit 1, from which the power supply voltage is provided to various circuit blocks 13, 14 and 15 in the integrated circuit 1.

The emitter voltage of the power supply transistor 11 is also applied to the differential amplifier 21 in the integrated circuit 1. Circuit blocks 13, 14 and 15 make loads for the power supply transistor 11.

The emitter voltage of the power supply transistor 11 is applied to an input terminal 22 of the differential amplifier 21, while a voltage at a midpoint connecting the resistances 17 and 18 is applied to the other input terminal 23 of the differential amplifier 21. The differential amplifier 21 generates an output voltage so that the two input voltages are equalized. The output voltage is applied to a buffer circuit 9 and is fed back to the input terminal 22 through the power supply transistor 11.

As a result, the voltages at the input terminal 22 and at the input terminal 23 are made equal always. The voltage applied to the input terminal 23 is obtained by dividing the voltage across the zener diode 5, which is insensitive to the change in the ambient temperature, proportionally to the ratio of resistances 17 and 18. The ratio of the resistances 17 and 18 is not affected by the change in the temperature.

Therefore, the voltage applied to the input terminal 23 is not affected by the change in the temperature. Consequently, the emitter voltage of the power supply transistor 11 is not affected by the change in the temperature and a constant voltage is supplied to the circuit blocks 13, 14 and 15.

A switch 19 turned on and off by a control signal from a pin 20 enables or disables the operation of the power supply circuit. When the switch 19 is closed, the input to the buffer circuit 9 is grounded to turn the power supply transistor off thus the operation of the power supply circuit is disabled. On the contrary, when the switch 19 is opened, the feed back operation by the differential amplifier 21 is performed, and the power supply circuit is put in operation.

The power supply circuit of this invention can provide the circuit blocks in the integrated circuit with the voltage unaffected by the change in the ambient temperature.

A power supply circuit for an integrated circuit, which can provide a constant voltage regardless of the change in the ambient temperature, is made available according to this invention.

This invention also has an effect to provide a power supply voltage unaffected by the change in the ambient temperature, even when temperature characteristics of a discrete transistor disposed outside the integrated circuit and temperature characteristics of the integrated circuit are different and there exists a temperature drift.

What is claimed is:

1. A power supply circuit comprising:

a constant voltage element to generate an output voltage insensitive to a change in ambient temperature;

a power supply transistor, to a base of which the output voltage of the constant voltage element is applied;

a load connected to an emitter of the power supply transistor; and a differential amplifier, to one input terminal of which an emitter voltage of the power supply transistor is applied, and to another input terminal of which a voltage corresponding to the output voltage of the constant voltage element is applied, wherein an output voltage of the differential amplifier is applied to the base of the power supply transistor.

2. The power supply circuit of the claim 1, wherein the constant voltage element, the load and the differential amplifier are disposed in an integrated circuit and the power supply transistor is disposed outside the integrated circuit.

3. The power supply circuit of the claim 1, further comprising a switch to connect or disconnect the base of the power supply transistor and a node at lower voltage than the emitter of the power supply transistor, wherein a power supply voltage is generated at the emitter of the power supply transistor by turning the switch on or off.

4. The power supply circuit of the claim 1, further comprising a switch to connect or disconnect the constant voltage element and the base of the power supply transistor, wherein a power supply voltage is generated at the emitter of the power supply transistor by turning the switch on or off.

5. A power supply circuit comprising:

a constant voltage element to generate an output voltage insensitive to a change in ambient temperature;

a first bleeder resistance dividing the output voltage of the constant voltage element;

a second bleeder resistance dividing the output voltage of the constant voltage element;

a power supply transistor, to a base of which an output of the first bleeder resistance is applied;

a load connected to an emitter of the power supply transistor; and a differential amplifier, to one input terminal of which an emitter voltage of the power supply transistor is applied, and to another input terminal of which an output voltage of the second bleeder resistance is applied, and an output voltage of which is applied to the base of the power supply transistor.

6. The power supply circuit of the claim 5, wherein the constant voltage element, the first bleeder resistance, the second bleeder resistance, the load and the differential amplifier are disposed in an integrated circuit and the power supply transistor is disposed outside the integrated circuit.

7. The power supply circuit of the claim 5, further comprising a switch connecting or disconnecting the base of the power supply transistor and a node at lower voltage than the emitter of the power supply transistor, wherein a power supply voltage is generated at the emitter of the power supply transistor by turning the switch on or off.

8. The power supply circuit of the claim 5, further comprising a switch connecting or disconnecting the constant voltage element and the base of the power supply transistor, wherein a power supply voltage is generated at the emitter of the power supply transistor by turning the switch on or off.

9. A power supply circuit comprising:

voltage generating means for generating an output voltage insensitive to a change in ambient temperature;

transistor means for supplying a power to a load, wherein the output voltage of the voltage generating means is applied to a base of the transistor means;

differentially amplifying means for applying an output voltage to the base of the transistor means so that an emitter voltage of the transistor means and a voltage corresponding to the output voltage of the voltage generating means are made equal.

* * * * *